United States Patent [19]

Fox

[11] Patent Number: 4,638,770

[45] Date of Patent: Jan. 27, 1987

[54] PORTING SYSTEM FOR TWO CYCLE INTERNAL COMBUSTION ENGINES

[76] Inventor: Duke Fox, 5305 Towson Ave., Ft. Smith, Ark. 72901

[21] Appl. No.: 775,588

[22] Filed: Sep. 13, 1985

[51] Int. Cl.[4] ..... F02B 75/40

[52] U.S. Cl. ..... 123/65 P; 123/65 PE; 123/65 W; 123/65 A

[58] Field of Search ..... 123/65 P, 65 PE, 65 A, 123/65 W

[56] References Cited

U.S. PATENT DOCUMENTS

| | | | |
|---|---|---|---|
| 1,967,682 | 7/1934 | Ochtman, Jr. | 123/65 A |
| 2,105,717 | 1/1938 | Burn | 123/65 A |
| 2,169,652 | 8/1939 | Ljungstrom | 123/65 PE |
| 2,204,296 | 6/1940 | Brooks | 123/65 W |
| 2,638,081 | 5/1953 | Spannhake | 123/65 A |
| 4,329,948 | 5/1982 | Fujikawa et al. | 123/73 AA |
| 4,373,474 | 2/1983 | Schindler et al. | 123/56 B |

FOREIGN PATENT DOCUMENTS

| | | | |
|---|---|---|---|
| 0110516 | 9/1981 | Japan | 123/65 PE |
| 0349423 | 5/1931 | United Kingdom | 123/65 P |

*Primary Examiner*—Willis R. Wolfe, Jr.

*Attorney, Agent, or Firm*—Laff, Whitesel, Conte & Saret

[57] ABSTRACT

A porting system for two-cycle internal combustion engines has two exhaust ports located on diametrically opposed sides of the cylinder. A pair of intake or by-pass ports are symmetrically positioned on each side of the two exhaust ports. The flow of fuel mixture is laminar and has a pattern which is inward and slightly upward from each intake port. As incoming streams collide, the gas flows upwardly and forms two mushrooms. Then, the flow is downwardly along the cylinder axis. The downward flow divides into two streams flowing radially outwardly from the center of the cylinder and out the two exhaust ports. With this flow pattern, there is a minimum of mixing of intake and exhaust gases, and as compared to the prior art, more unburned gas is retained in the cylinder to improve power output and reduce fuel consumption.

6 Claims, 8 Drawing Figures

MODIFIED SCHNUERLE
FIG.1B
(PRIOR ART)
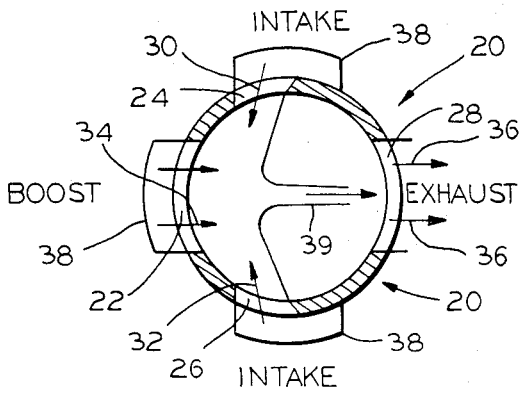
VILLERS PORT
FIG.2B
(PRIOR ART)
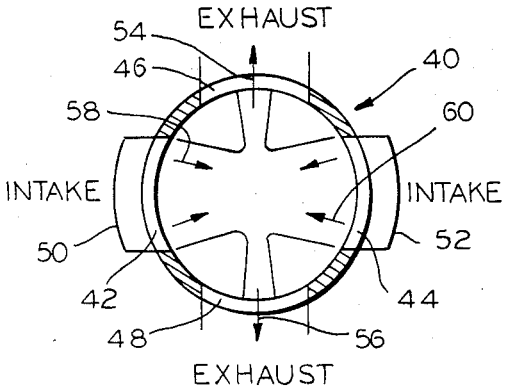
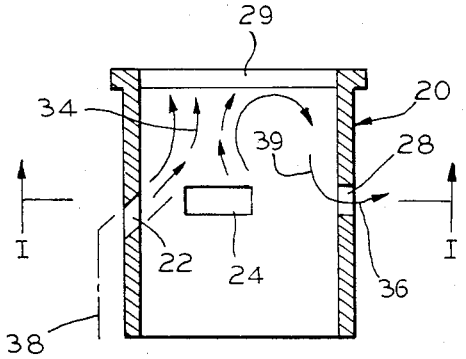
FIG.1A
(PRIOR ART)
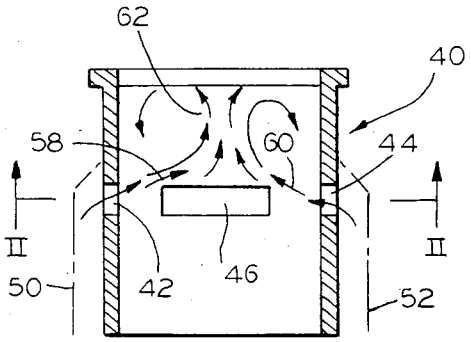
FIG.2A
(PRIOR ART)

LOOP PORT
FIG.3B
(PRIOR ART)
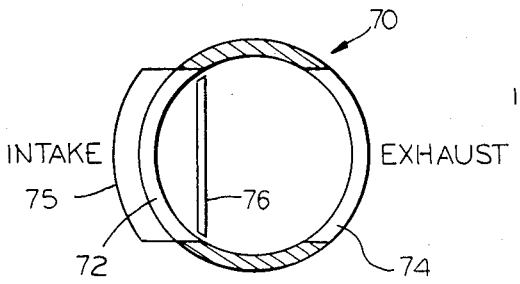
FIG.4B
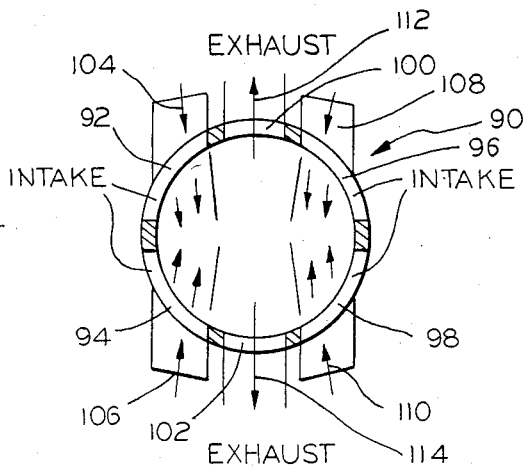
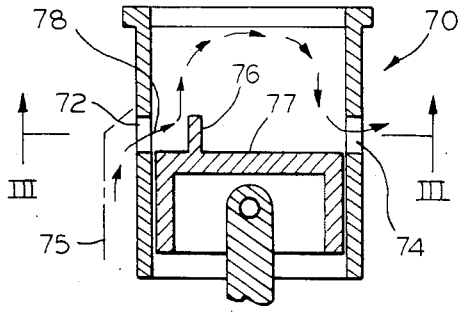
FIG.3A
(PRIOR ART)
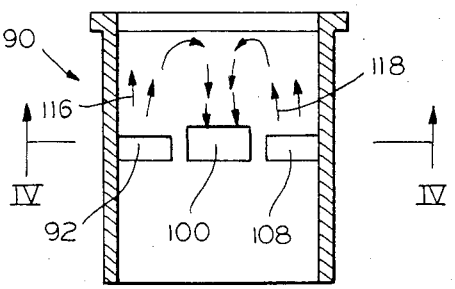
FIG.4A

PORTING SYSTEM FOR TWO CYCLE INTERNAL COMBUSTION ENGINES

This invention relates to cylinder porting arrangements for two cycle engines of the types sometimes used on model airplanes, lawn mowers, weed cutters, chain saws, lightweight motorcycles and the like. However, the invention is not necessarily limited to engines for these particular uses.

By their nature, two cycle engines exhaust their burned gasses and introduce fresh and unburned gasses into the cylinder nearly simultaneously. The best known porting systems now known lose a fair portion of the unburned gas along with the exhaust gas and may retain a fair portion of burned gas along with the unburned gas. In greater detail, two cycle engines have been used for a long period of time. However, the porting systems used in such engines do not lend themselves to scientific or mathematical analysis. Moreover, laminar flow gasses and turbulent flow gasses within the cylinder behave in different ways. A result is that most porting advances in these two cycle engines have resulted from blindly cutting and trying.

Most of the presently used two cycle engines have porting arrangements that fall into one of the following three general categories: Schnuerle, Villers and Loop. The Schnuerle system has one exhaust and two intake or by-pass ports which are positioned approximatly 180° from each other and 90° from the exhaust port. Later refinements have added a "boost" port opposite the exhaust port and directed upward. The Villers system has two intakes or by-pass ports at 180° and two exhaust ports also at 180°, the intake ports being offset from the exhaust ports by 90° intervals, all degrees being measured around the circumference of the cylinder. Thus, in Villers, two streams of intake or by-pass gasses are directed at each other, impinging upon each other and causing turbulence at the center of the cylinder, and forms a turbulent upwardly flowing mushroom. In the loop system, the intake or by-pass gas enters an intake or by-pass port in one side of the cylinder, and is deflected upwardly by means of a piston deflector or a faired port. The exhaust gasses pass out an exhaust port the opposite side of the cylinder.

Of course, there are many variations of these types of porting systems, with extra ports being provided in an attempt to scavenge the uncleansed areas within the cylinder. Also, there are still other porting systems using piston valves and head valves.

An object of this invention is to improve power, and RPM, and to reduce fuel consumption and exhaust emissions in two cycle engines. Another object is to improve the scavenging of burned gas in the cylinders of a two cycle engine.

In keeping with an aspect of the invention, a porting system for two-cycle internal combustion engines has two exhaust ports which are located on opposite sides of the cylinder. By positioning the by-pass ports in a new manner, and by properly directing the intake or by-pass flow, a better separation of burned, and unburned gasses is achieved. More particularly, a pair of intake or by-pass ports are symmetrically positioned on each side of the two exhaust ports and so shaped that the by-passing gas flows into the cylinder approximately parallel to a line drawn between the two exhaust ports. Since the desired flow path is not toward the cylinder center, one or more of various devices are used to direct the gas into the desired path. These devices may include chamfering or otherwise shaping the top of the piston; angling the port; offsetting the by-pass channel relative to the port; or angling the by-pass channel relative to the cylinder bore.

The gas flows in two pairs of streams and each pair impinge on a line 90° with respect to a line drawn between the exhaust ports, and nearer the cylinder wall than the cylinder centerline. After impinging, the gas velocity is slowed, and becomes too turbulent upwardly and outwardly flowing mushrooms which reach the cylinder head, spread and start filling the cylinder from the head down. As the upper cylinder is filled, the burned gasses flow downwardly between the two upwardly flowing by-pass columns, and eventually flows out of the exhaust ports.

With this flow pattern, there is a minimum of mixing of intake and exhaust gases as compared to the prior art. More unburned gas is retained in the cylinder. When more unburned fuel is retained, there is an improved power output, and a reduction in fuel consumption and in undesirable exhaust emissions. Furthermore, a shorter and more direct movement of the gasses can be accomplished in a shorter period of time, which makes a higher R.P.M. possible. A further advantage of this new porting system is that no deflectors are required on the piston, thus reducing cost, weight, and heat absorbing area.

Both the prior art and a preferred embodiment of the invention are seen in the attached drawings, wherein:

FIGS. 1A and B each is a schematic showing of a prior art Schnuerle porting arrangement, FIG. 1A being a vertical cross-section of a cylinder, and FIG. 1B being a cross-section taken along line I—I of FIG. 1A;

FIGS. 2A and B each is a schematic showing of a prior art Villers porting arrangement, FIG. 2A being a vertical cross-section of a cylinder, and FIG. 2B being a cross-section taken along line II—II of FIG. 2A.

FIGS. 3A and B each is a schematic showing of a prior art Loop porting arrangement, FIG. 3A being a vertical cross-section of a cylinder and part of a piston, and FIG. 3B being a cross-section taken along line III—III of FIG. 3A; and FIGS. 4A and B each is a schematic showing of the inventive porting system, FIG. 4A being a vertical cross-section of a cylinder, and FIG. 4B being a cross-section taken along line IV—IV of FIG. 4A.

FIG. 1A shows a vertical cross-section of a cylinder 20 having ports 22–28 formed herein, according to the Schnuerle Plan. A cylinder head (not shown) of known form covers the top 29 of the cylinder. A conventional piston (also not shown) moves reciprocally from a location just below the ports 22–28 (as viewed in FIG. 1A) to a position near the top 29 of the cylinder. These four ports 22–28 are distributed at 90° intervals around the periphery of the cylinder 20 with the exhaust port 28 positioned between the intake ports 24, 26 and opposite a boost port 22. Lines 38 indicate manifold positions for bringing the mixture of fresh fuel and combustion air into the intake ports 22–26.

As the piston moves down to uncover the ports, a mixture 30–34 of air, unburned fuel and possibly lubricant flows into the cylinder through intake ports 22–26. Also the expanding exhaust gases force their way out the exhaust port 28. When the piston initially moves up in this prior art engine, a mixture of both the unburned fuel and the burned exhaust gas are forced out of the ports. Once the piston clears the port area, the intake into and the exhaust out of the cylinder terminate so that a combination of fresh fuel and exhaust gas remain in the cylinder, to be burned or reburned.

The arrangement is such that the confronting streams 30, 32 of fresh fuel and air collide, become turbulent and are directed upwardly toward the top of the cylinder. To assist in creating an upwardly moving stream, fresh fuel and air 34 is sometimes brought in through boost port 22 to collide with the turbulence and also to deflect the fuel mixture upwardly. As best seen in FIG. 1A, the boost port 22 is angled upwardly to give an up bias to the draft of the input fuel mixture stream. When the rising stream strikes the underside of the cylinder head where it mushrooms and is deflected downwardly at 39, toward and out the exhaust port 28, as indicated by the arrow 36.

FIG. 2A shows a vertical cross-section of a cylinder 40 having four ports 42–48 formed therein, according to the Villers plan. Again, a conventional cylinder head (not shown) covers the top of the cylinder in FIG. 2A. A piston (not shown) reciprocally moves from a position below the ports to a position near the top of a cylinder. Again the ports are distributed at 90° intervals around the circumference of the cylinder. Two intake ports 42, 44 (FIG. 2B) are positioned opposite each other and, 90° displaced therefrom, two exhaust ports 46, 48 are opposite each other. The lines 50, 52 indicates intake manifolds.

When the piston moves down to a level which is below the ports, the expanding exhaust gasses 54, 56 force their way out the exhaust ports 46, 48, while the incoming streams of fuel mixture 58, 60 are directed toward each other. As the two intake streams 58, 60 of gas collide, there is a turbulence and an upward draft at 62. As the up draft 62 strikes the bottom of the cylinder head, it mushrooms and is directed outwardly and then downwardly along the walls of the cylinder toward the exhaust ports 46, 48, where it is expelled as twin streams 54, 56.

FIG. 3A shows a vertical half of a cylinder 70 having two opposing ports, of which port 72 is an intake and port 74 is an exhaust, this arrangement being called a "loop port" system. A manifold is shown at 75. A deflector 76 is positioned on top of the piston 77 to deflect the incoming air stream 78 upwardly and toward the top of the cylinder.

As the bypassing fuel mixture flows through intake port 72 and into the cylinder, the flow is deflected upwardly toward the top of the cylinder, across the top, down and out the exhaust port 74.

In each of these three known systems (FIGS. 1–3), the intake stream of fuel mixture is used to scavenge the exhaust fuel so that the expelled stream includes a large volume of unburned fuel.

According to the invention, (FIG. 4A) cylinder 90 has a porting system with six ports 92, 94, 96, 98 100, 102 distributed around the periphery. Two relatively narrow exhaust ports 100, 102 are located on opposite sides of the cylinder 90, 180° away from each other as measured around the cylinder. Two pairs of intake or by-pass ports 92, 94 and 96, 98 are positioned on each of the opposite sides of the exhaust ports. The ports are positioned and shaped so that four intake streams of fuel mixture flow toward each other and collide, as shown by arrows 104, 106 and 108, 110 (FIG. 4B). At each of the points of collision, there is an upwardly directed flow of intake gas from each of the intake ports 92, 108. The incoming fresh streams of unburned fuel flows in directions which are opposite to the directions in which the exhaust streams 112, 114 flow. Thus, the intake fuel mixture has a laminar flow which does not intermix with the exhaust gasses flowing out the cylinder at exhaust ports 100, 102.

The two pairs of intake streams 104, 106 and 108, 110 (FIG. 4B) impinge upon each other at points along a line 90° offset from a line drawn between the exhaust ports. Upon impinging, their velocity is greatly reduced, and the flow of fuel mixture becomes turbulent. As a result, two upwardly deflected streams 116, 118 (FIG. 4A) are formed at points along a line which is displaced 90° with respect to a line drawn through the centers of the exhaust ports. These streams continue upwardly toward the cylinder head where they mushroom, expand, progressively fill the cylinder and continue downwardly toward the exhaust ports 100, 102.

The inventive flow pattern retains more unburned gasses within and expels more burned gasses from the cylinder as compared to the conventional flow patterns.

It should be understood that the invention relates to the flow and the movement of the gasses. The porting arrangement is a method of achieving it. Engines have been made employing the Villers scavenging system which have dual by-passes, instead of the single by-passes shown in FIG. 2B; however, they all pair the gas flows to impinge in the center of the cylinder. A slight external similarity between such an engine and the invention should not be confused with the functions of the two, which are quite different.

The important difference between the inventive system and the Villers system is that the "rooster tail", formed by the impinging streams, flows directly toward the exhaust port in the Villers system while in the inventive system, the rooster tail formed by the impinging gas flow is 90° away from the exhaust port, and is, therefore, retained, not lost. A second important difference is that the inventive system has two mushroom columns, each of which flows upwardly toward the center of the cylinder head, spreads, and then fills downwardly. In the Villers system, the mushroom flows up the center then outwardly trapping a certain amount of burned gasses above each intake or by-pass port.

Those who are skilled in the art will readily perceive how to modify the invention. Therefore, the appended claims are to be construed to cover all equivalent structures which fall within the true scope and spirit of the invention.

The claimed invention is:

1. A porting system for two cycle engines comprising a cylinder having two exhaust ports positioned on diametrically opposed sides of the cylinder, four intake ports, one of said intake ports being positioned on each of the four opposite sides of said two exhaust ports, and means for feeding an incoming stream of a fuel mixture through each of said intake ports, each of said incoming streams being fed into said cylinder directly toward another individually associated stream on the same side of said exhaust ports and with sufficient velocity to cause turbulence in areas where said incoming streams collide, the intake streams having sufficient velocity to produce a laminar flow which preludes a mixing of intake and exhaust streams.

2. The system of claim 1 wherein said turbulence causes two colliding incoming streams to merge and rise to the top of the cylinder, mushroom, and then descend into and filling the space between the laminar flow of the four incoming streams.

3. The system of claim 2 wherein said descending and filling flow streams push the burnt gasses out the exhaust ports.

4. A method of scavenging a cylinder of a two-cycle engine, said method comprising the steps of:

forming six ports in the walls of said cylinder, two of said ports being diametrically opposed to each other, the other four ports being formed on opposite sides of said two ports;

directing a plurality of incoming streams of a fuel mixture through said four ports, pairs of said incoming streams being directed toward each other within said cylinder, a space in the center of the cylinder remaining between said incoming streams;

giving said incoming streams a velocity which is sufficient to cause turbulence in the area where the incoming streams collide, said velocity also being sufficient to producing a laminar flow along at least the edges of incoming streams confronting said center space between said incoming streams;

said colliding streams rising within said cylinder striking the top of said cylinder, mushrooming, and descending into said center space between said incoming streams; and said exhaust ports being positioned at opposite ends of said center space for enabling said descending stream to exit said port.

5. The method of claim 4 wherein the collisions between said incoming streams occur on approximately diametrically opposed sides of said cylinder.

6. The method of claim 5 wherein there are two of said rising streams extending upwardly from said collisions.

* * * * *